US008262175B2

(12) United States Patent
Lam et al.

(10) Patent No.: US 8,262,175 B2
(45) Date of Patent: Sep. 11, 2012

(54) DRAWER FITTING

(75) Inventors: Harn Lian Lam, Perak (MY); Harn Yan Lam, Perak (MY)

(73) Assignee: Harn Marketing Sdn. Bhd., Ipoh, Perak (MY)

( * ) Notice: Subject to any disclaimer, the term of this patent is extended or adjusted under 35 U.S.C. 154(b) by 848 days.

(21) Appl. No.: 12/304,894

(22) PCT Filed: Jun. 8, 2007

(86) PCT No.: PCT/IB2007/001595

§ 371 (c)(1),
(2), (4) Date: Dec. 15, 2008

(87) PCT Pub. No.: WO2008/010036

PCT Pub. Date: Jan. 24, 2008

(65) Prior Publication Data

US 2009/0174299 A1 Jul. 9, 2009

(30) Foreign Application Priority Data

Jul. 14, 2006 (MY) ..... PI 20063374

(51) Int. Cl.
*A47B 88/00* (2006.01)

(52) U.S. Cl. ..... 312/348.4

(58) Field of Classification Search ..... 312/263, 312/330.1, 334.1, 334.4, 334.7, 348.1, 348.2, 312/348.4

See application file for complete search history.

(56) References Cited

U.S. PATENT DOCUMENTS

| | | | | |
|---|---|---|---|---|
| 4,815,796 | A * | 3/1989 | Rock et al. | 312/263 |
| 4,995,683 | A * | 2/1991 | Albiez | 312/348.4 |
| 5,505,554 | A * | 4/1996 | Lautenschlager Horst et al. | 403/12 |
| 6,027,194 | A * | 2/2000 | Fleisch | 312/348.4 |
| 6,179,399 | B1 * | 1/2001 | Brustle et al. | 312/348.4 |
| 6,286,919 | B1 * | 9/2001 | Fleisch | 312/348.4 |
| 2004/0000849 | A1 | 1/2004 | Lam et al. | |
| 2005/0017615 | A1 * | 1/2005 | Salice | 312/348.4 |

FOREIGN PATENT DOCUMENTS

| | | | |
|---|---|---|---|
| DE | 19606713 | A1 | 8/1997 |
| EP | 0637213 | B | 10/1996 |
| EP | 0862873 | A1 | 9/1998 |

* cited by examiner

*Primary Examiner* — James O Hansen
*Assistant Examiner* — Matthew Ing
(74) *Attorney, Agent, or Firm* — Volpe and Koenig, P.C.

(57) ABSTRACT

A drawer fitting fixes a drawer side to a drawer front panel. The fitting includes a holding plate for mounting the fitting to the drawer front panel, the holding plate having a flange extending in a direction parallel to a drawer side, the flange having forwardly-disposed guide noses, a clamping plate having a forwardly-disposed angled flange, a guide clip mountable on the clamping plate such that the drawer side front end can be positioned between the holding plate flange and the guide clip, the guide clip having resiliently depressible projecting tails and an assembly screw that passes through and couples together the clamping plate and guide clip, and is received in an aperture in the holding plate flange through a recess in the front end of the drawer side.

16 Claims, 8 Drawing Sheets

DRAWER FITTING

The invention relates to a drawer fitting for use in a knock-down drawer assembly and more particularly a fitting for fixing the drawer sides to the front panel of the drawer assembly.

DESCRIPTION OF THE PRIOR ART

Drawer assemblies are often designed to be knocked down for the purposes of ease of transportation or flexibility of configuration. The knocked down parts of drawers of this type must be easily assembled by the general public without the requirement of specialized tools or skills. Known knock-down drawer assemblies generally consist of a bottom panel, a front panel, a back panel and a pair of side panels affixed to and extending parallel between the front and rear panels as well as engaged with the bottom panel along its longitudinal length.

With new construction materials and methods, drawers are no longer solely made from wood or wood products; other materials such as formed sheet metals or plastic moldings are increasingly being used. It is now common to have a drawer assembled with parts made from a variety of materials. Particularly, it is becoming increasingly known for drawer side panels to be made from sheet metal and assembled with front, back and bottom panels that may be made from the same metal material or other materials, such as wood, for example. For such drawer assemblies, it is therefore necessary to provide suitable fittings for securely affixing such side panels to both the drawer front and back panels.

This invention is concerned with a suitable drawer fitting for fixing the side panels to the drawer front panel. Such a fitting is disclosed in U.S. Pat. No. 4,815,796 A ('796 patent). In this US patent, a holding member (drawer fitting) comprises a holding plate and a clamping plate, both elements joined together by means of an attachment screw. The holding plate has a laterally projecting flange for attaching the holding plate to the drawer front panel via screws. Apertures for receiving an attachment screw and an eccentric are provided on the holding plate. The clamping plate is provided with an edge flange having a nose with a wedge surface, located at the front edge of the plate. A pair of openings corresponding to the holding plate apertures, one opening through which the attachment screw projects and another opening which allows access to the eccentric, is also provided on the clamping plate. Additionally, each side panel is provided with a recess that opens at the front edge of the side panel. The recess has a forwardly disposed nose that projects vertically upwards into the recess so that the holding plate may be hung therefrom by way of the eccentric, and the rear portion of the recess is provided with an oblique edge. A vertical slot is also formed on the side panel behind the recess for engagement with the wedge-shaped nose of the clamping plate.

This prior holding member (drawer fitting) is assembled by firstly, screwing the laterally projecting holding plate flange of the holding member onto a rear surface of the front panel. Subsequently, a side panel is inserted between the holding plate and clamping plate with the eccentric hung in the side panel recess behind the recess nose so that the front panel is supported or hung onto the side panel. In this state, the wedge-shaped nose projects into the side panel slot. The attachment screw is then tightened resulting in the clamping plate being pressed towards the holding plate, the wedge-shaped nose pressed further into the side panel slot. Due to the wedge surface of the nose acting against the slot edge, the clamping plate together with the holding plate are pulled in a rearwards direction with the laterally projecting flange of the holding plate pressed onto the side panel front edge, thereby fastening the side panel to the front panel.

Another fitting (holder) is disclosed in U.S. Pat. No. 6,286,919 B1 ('919 patent) for hanging the side panels onto the drawer front panel. The holder, fixed onto the front panel, protrudes towards the side panel and consists of a supporting plate and a pressing plate disposed opposite the supporting plate. A side panel is clamped between the plates by means of a clamping screw, which extends through the pressing plate via a hole and is screwed into a threaded piece of the supporting plate. The supporting plate is a bent portion of the mounting flange (for fixing the holder to the front panel). The mounting flange extends over a front end of the side panel and has punched out lugs bent like hooks, on which the pressing plate is hung via its engagement hooks, the lugs disposed at the face of the side panel opposite the supporting plate. The pressing plate has a wedge portion that protrudes toward the supporting plate and is insertable into a widened portion of an insertion slot provided on the side panel. One of the wedge faces of the wedge portion act against an edge of the widened portion of the slot, constituting a locking stop. The side panel insertion slot is located at a front end of the panel, extending in a longitudinal direction of the panel with the widened portion transverse to the longitudinal direction, the slot allowing for access to the clamping screw.

This prior holder is mounted onto the side panel by introducing the clamping screw into the side panel insertion slot and subsequently tightening the screw. The pressing plate engagement hooks hung onto the mounting flange lugs produce a positive pulling connection between the mounting flange and pressing plate. Vertical position of the holder relative to the side panel is determined by the eccentric mounted on the supporting plate and engagable with the insertion slot such that the lower edge of the slot forms a supporting stop for adjusting the eccentric.

It is obvious from the above description, that the coupling or engagement between the clamping/pressing plate of the fitting (mounted onto front panel) and the side panels in both prior drawer fittings of the '796 and '919 patents is dependent on the wedge-shaped nose ('796 patent)/wedge portion ('919 patent) of the clamping plate, being properly and fully inserted into the side panel slot. It can be said that the locking stops, for both these prior fittings, are formed due to interaction between a flat edge of the slot and an angled (sloping) face of a wedge. Such interaction between a flat face and an angled face will result in a less than secure engagement between the side panel and the drawer fitting. When the drawer assembly having the fitting of either the '796 or '919 patent, is pushed shut with excessive force, neither of the wedged nose or wedge portion of both clamping plates would be able to withstand such force. As a result, both these wedge noses/portions may be disengaged from their respective side panel slots, resulting in disengagement of the side panels from the fittings mounted on the front panel.

Additionally, neither of the prior fittings of both the '796 and '919 patents provides means for guiding the lateral and forwardly movement of the clamping/pressing plate towards the side panel and front panel, respectively, during assembly or disassembly of the fittings. Movement of the clamping/pressing plate in both the prior fittings is a result of application of a clamping force by tightening the attachment screw. However, it is imperative that these movements are guided to be substantially parallel with both the side panel and the front panel as the lack of a suitable guide means, will likely result in sideways tilting or twisting of the clamping/pressing plate, during tightening of the attachment screw. This will inevitably result in misalignment of the wedge nose/portions with its corresponding side panel slot, and therefore, improper engagement between the side panel and fitting (front panel). Therefore, in both cases, secure engagement of the side panel to the drawer front panel as well as parallel alignment of the two side panels on either sides of the drawer assembly will be made unduly difficult and depend largely on the skill of the user assembling these fittings.

This invention thus aims to alleviate some or all of the problems of the prior art, and to provide a drawer fitting that is easily assembled and adjustable without compromising secure engagement of the drawer sides to the drawer front panel.

SUMMARY OF THE INVENTION

In accordance with an aspect of the invention, there is provided a drawer fitting for fixing a drawer side to a drawer front panel, the fitting comprising a holding plate for mounting the fitting to the drawer front panel, the holding plate having a flange extending in a direction parallel to a drawer side, the flange having a forwardly-disposed guide formation, a clamping plate having a forwardly-disposed angled flange, a guide clip mountable on the clamping plate such that the drawer side front end can be positioned between the holding plate flange and the guide clip, the guide clip having resiliently depressible projecting tails, and an assembly screw that passes through and couples together the clamping plate and guide clip, and the screw being received in an aperture in said holding plate flange through a recess in the front end of the drawer side. When clamping force is applied to the fitting by tightening the assembly screw, the clamping plate angled flange rides over the holding plate guide formation so as to simultaneously move the clamping plate with clip both forwardly towards the front panel and laterally towards the holding plate flange, movement of the clamping plate toward the drawer front panel causing the guide clip projecting tails to be pressed in at the rear of the drawer front panel. When the assembly is loosened by unscrewing the assembly screw, the projecting tails relax to push the clamping plate with clip rearwardly while being withdrawn laterally under the screw action, thus maintaining the clamping plate and clip substantially parallel to the holding plate flange to facilitate adjustment or removal of the drawer side.

In an embodiment of the invention, the clamping plate comprises an opening through which the assembly screw passes.

According to another embodiment, the guide clip comprises an opening through which the assembly screw passes. The guide clip opening may comprise a pair of retaining shoulders disposed to interact with the assembly screw between the screw head portion and screw thread portion, so as to couple the assembly screw and guide clip such that the clamping plate is held therebetween.

In another embodiment, the clamping plate further comprises a second opening through which an eccentric for adjusting the vertical position of the drawer front panel, passes. The holding plate flange may comprise a second aperture corresponding to the clamping plate second opening for receiving the eccentric.

According to a further embodiment, the clamping plate second opening further comprises a cut-in portion. The guide clip may comprise a tab insertable into the cut-in portion of the clamping plate second opening for mounting the guide clip onto the clamping plate.

In yet another embodiment, the clamping plate further comprises a depression. The front end of the drawer side may comprise a projection that interacts with the clamping plate depression with such an interaction forming a locking stop between the drawer side and the clamping plate. The projection has a flat face substantially parallel to the front edge of the drawer side and the depression has a flat edge, the flat face of the projection abutting against the flat edge of the depression, forming the locking stop thereat.

According to another embodiment, the projection is integral with the drawer side.

In a further embodiment, the guide clip projecting tails are integral with the guide clip.

In a still further embodiment, the guide clip is made of a plastic material.

According to a further embodiment, the drawer side is made of sheet metal.

According to another aspect, the invention provides a drawer including a front panel and two drawer sides, each side joined to one longitudinal end of the front panel by a respective drawer fitting as described above.

The aim of the invention is to provide a drawer fitting which permits secure anchoring of drawer sides to the drawer front panel, easy removal as well as adjustments during assembly of the drawer.

The action of the clamping plate angled plate riding over the holding plate flange guide formation when the assembly screw is tightened, ensures that the clamping plate is guided to be substantially parallel with both the side panel and front panel as it moves laterally towards the holding plate flange (side panel) and forwardly towards the holding plate (drawer front panel). Consequently, the flat face of the side panel projection abuts fully against the flat front edge of the clamping plate depression, thus ensuring proper engagement between the drawer side and clamping plate of drawer fitting (front panel).

Additionally, as mentioned above, the resilient guide clip projecting tails are pressed in at the rear of the drawer front panel when the assembly screw is tightened. Upon loosening of the assembly screw, the projecting tails are relaxed (reverting to original state) and urge the clamping plate angled flange back over the holding plate flange guide formation. The relaxing motion of the projecting tails at the rear of the front panel when clamping force is relieved, guides the clamping plate such that it remains substantially parallel to both the side panel and front panel whilst moving laterally and rearwardly away from both the holding plate and holding plate flange, respectively. This feature ensures that all the essential elements of the fitting and side panel, such as the flat face of the side panel projection and flat front edge of the clamping plate depression; and openings on the clamping plate, apertures on the holding plate flange and side panel recesses, remain in alignment during loosening and tightening of the assembly screw, allowing for the side panel to be easily adjustable or removable from the fitting (front panel).

Also, interaction between the retaining shoulders of the guide clip opening and the assembly screw (between screw head portion and thread portion) will ensure that the clamping plate is lifted from its engagement with the holding plate flange, in line with the movement of the assembly screw, when the assembly screw is loosened or unscrewed.

Furthermore, the locking stop formed between the side panel and clamping plate of the fitting is secure as the stop is formed from the interaction between the side panel projection flat face and the flat front edge of the clamping plate depression i.e. interaction between two substantially flat surfaces that overlie one another in a mutually parallel manner in the locked state. Such an interaction is very secure as the interacting surface area between the two elements is maximized in comparison to interaction between a flat surface and an angled or sloping surface. This allows the drawer fitting to be robust and able to withstand the drawer assembly being closed with excessive force without the drawer side being disengaged from the front panel.

BRIEF DESCRIPTION OF THE DRAWINGS

The invention is illustrated, although not limited, by the following description of embodiments made with reference to the accompanying drawings in which.

DETAILED DESCRIPTION OF THE EMBODIMENTS

Figure 1:
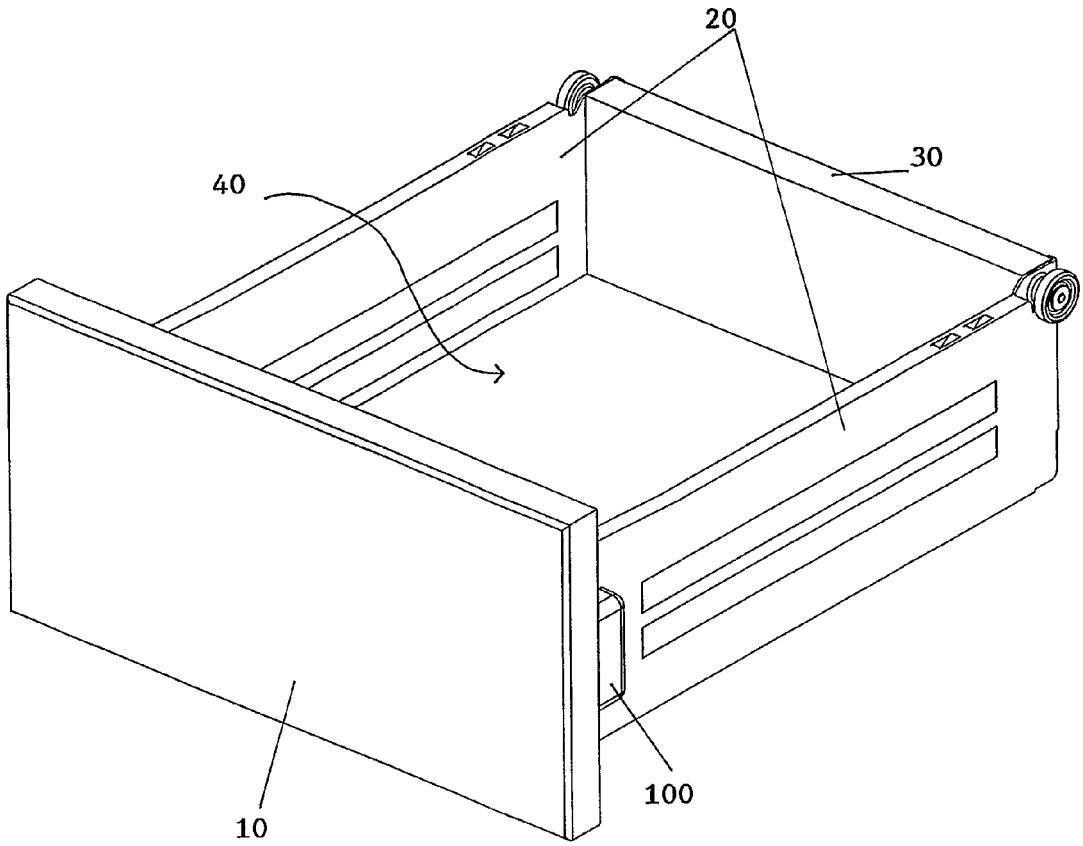
FIG. 1 shows a perspective view of a drawer assembly with a drawer fitting of a preferred embodiment for fixing each drawer side to a respective longitudinal end of the drawer front panel.
Figure 2:
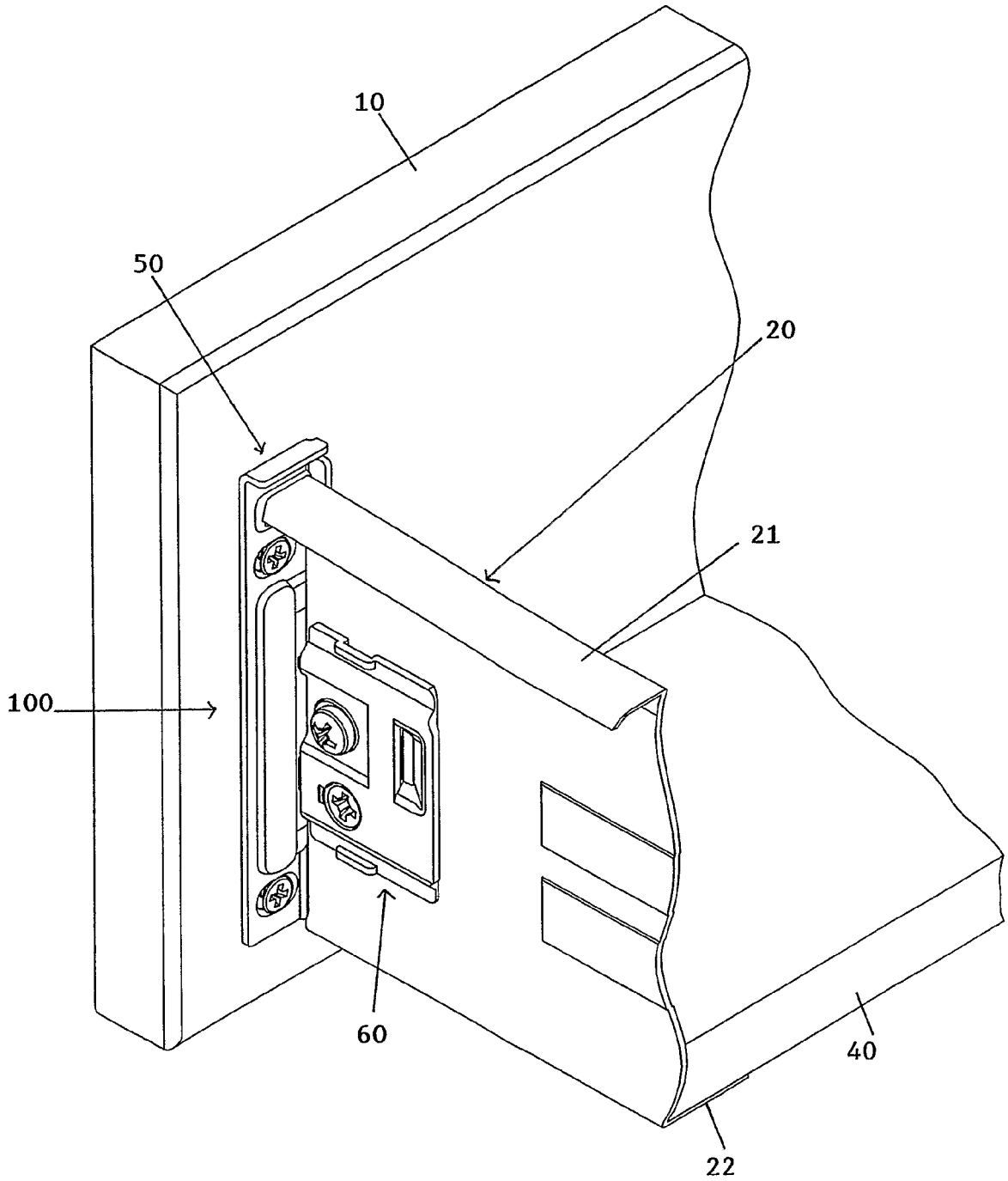
FIG. 2 shows a longitudinal end of the drawer front panel having a drawer side fixed thereto via a preferred embodiment of the drawer fitting.
Figure 3:
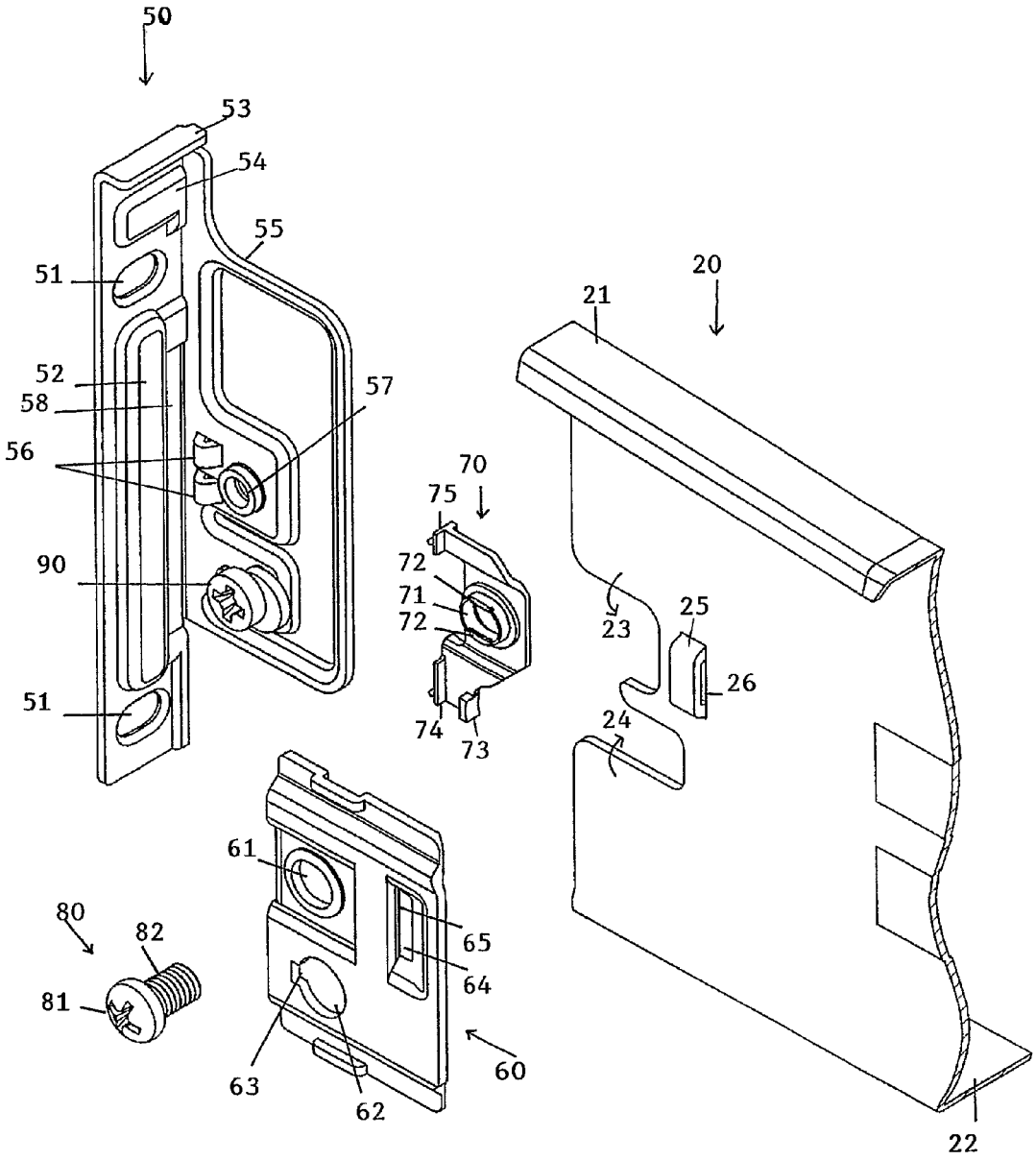
FIG. 3 shows an exploded view of the drawer fitting of FIG. 2.

FIGS. 1 and 2 show a drawer assembly comprising a front panel 10, a rear panel 30, a bottom panel 40 as well as drawer sides 20 extending between the front 10 and rear 30 panels at each side of the drawer assembly. The bottom 40 and rear 30 panels of the drawer are joined to the drawer sides 20 in a conventional manner. The drawer sides 20 are preferably made of metal material with each drawer side 20 fixed to a longitudinal end of the drawer front panel 10 by a drawer fitting 100 of the present invention. A preferred embodiment of the drawer fitting 100 of this invention is seen in FIG. 3. This drawer fitting 100 comprises a holding plate 50, a clamping plate 60, a guide clip 70 as well as an assembly screw 80.

The holding plate 50 of the drawer fitting 100 is preferably made of metal and mounted at a longitudinal end of the rear surface of the drawer front panel 10 via screws (or the like) through openings 51 provided towards the top and bottom portion of the holding plate 50. The top of the holding plate 50 is bent rearwardly, forming a flap 53. In order to strengthen the holding plate 50, an upper embossed portion 54 below flap 53 and a vertically elongate embossed portion 52 are provided thereon. The holding plate 50 has a flange 55 that extends perpendicularly from the plate 50, in a direction parallel to the drawer side 20. A surface portion 58 of the holding plate 50, between the vertical embossed portion 52 and holding plate flange 55, is the contact surface for a front portion 76 of the guide clip 70, when both the clamping plate 60 and guide clip 70 are mounted on the holding plate. The holding plate flange 55 has a guide nose formation 56, here in the form of a pair of guide noses, disposed towards its front portion. The guide nose formation 56 defines a forwardly-directed sloping guide surface. Additionally, two vertically spaced apertures, the first aperture 57 for receiving the assembly screw 80 and the second aperture (not visible in FIG. 3) for receiving an eccentric 90, are also provided on the holding plate flange 55, with the first aperture 57 located above the second aperture. These apertures are located behind the guide formation 56 on the holding plate flange 55.

Figure 4:
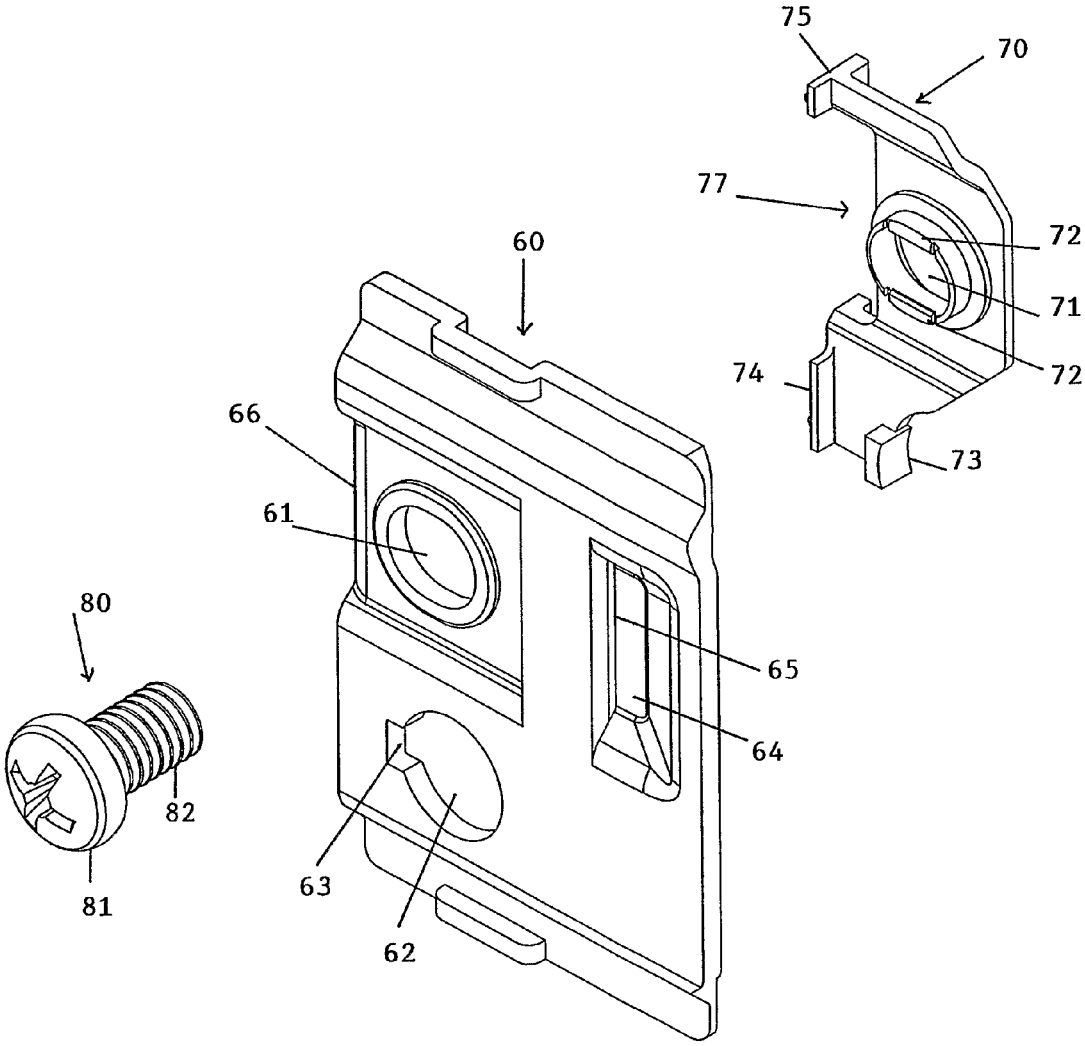
FIG. 4 is an enlarged view of the assembly screw, clamping plate and guide clip of FIG. 2.
Figure 6A:
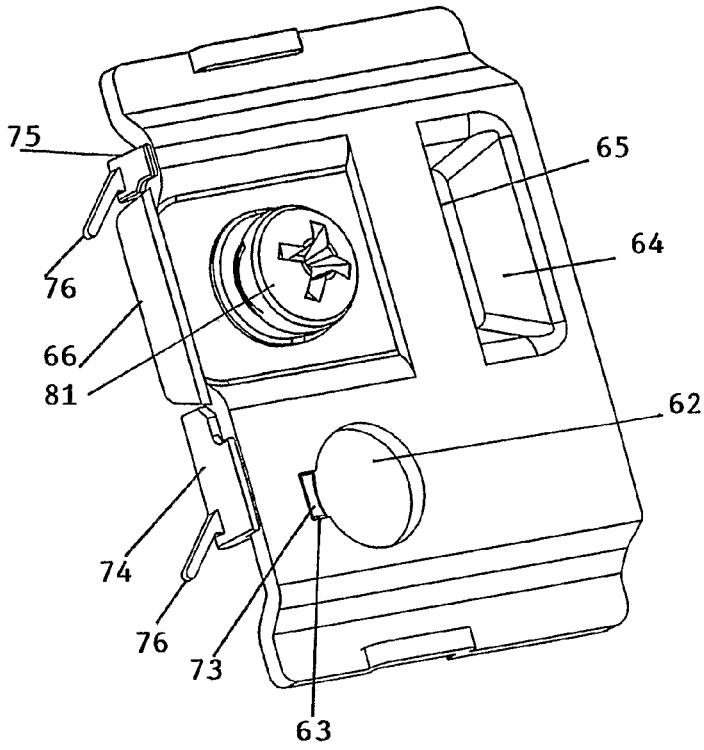
FIG. 6A is a perspective view of FIG. 5B as seen from a surface of the clamping plate that faces away from the side panel.

As seen in both FIGS. 3 and 4, the clamping plate 60 is substantially rectangular in shape and has an angled flange 66 at its front end edge (best seen in FIG. 6A). The clamping plate 60 is preferably made of metal and is provided with a pair of vertically spaced apart openings at its front portion, the first opening 61 through which the assembly screw 80 passes and the second opening 62 which allows access to the eccentric 90, with the first opening 61 located above the second opening 62. The second opening 62 of the clamping plate 60 has a cut-in section 63 for accommodating a portion 73 of the guide clip 70. A portion of the clamping plate 60 towards its rear is stamped inwards to form a depression 64 having a substantially flat front edge 65 that abuts against a portion 25 of the drawer side 20, when the fitting 100 is assembled. This clamping plate depression 64 is seen as a projection 64 from the clamping plate inner face when viewed from the major face of the drawer side panel that confronts the clamping plate 60 (best seen in FIG. 6B).

Also shown in FIGS. 3 and 4 is the guide clip 70 for mounting onto the clamping plate 60, the clip preferably made of plastic material. The clip 70 has a centrally located opening 71 through which the assembly screw 80 passes. The guide clip opening 71 has a rim on the side of clip 70 that faces clamping plate 60. This rim is provided with a pair of retaining shoulders 72 for interaction with the assembly screw 80, with one retaining shoulder 72 located towards a top portion of the rim and the other 72 located towards a bottom portion of the rim. Two flanges, one at the top 75 and one at the bottom 74, are provided at the front edge of the clip 70. A recess 77 that opens in a forward direction is located in between these two front edge flanges 74, 75. When the clip 70 is mounted onto the clamping plate 60, both front edge flanges 74, 75 will abut against the front edge of the clamping plate 60. Additionally, each front edge flange 74, 75 has a resiliently depressible projecting tail 76 that contacts and is pressed against the holding plate 50 on its surface portion 58, at the rear of the drawer front panel 10, when the drawer fitting 100 is completely assembled. These resilient depressible tails 76 project away from each front edge flange 74, 75 at a downward angle. It is preferred that these projecting tails 76 are integral to the guide clip 70, although it is also possible that these tails 76 are provided to be separable from the guide clip 70. A mounting tab 73 insertable into the cut-in section 63 of the clamping plate second opening 62 is provided at a bottom edge of the clip 70, towards its rear portion.

In FIG. 3, the drawer side 20 of a drawer assembly, preferably made of sheet metal, for assembly together with the drawer fitting 100 of this invention is shown. Preferably, the top edge of the drawer side 20 is bent outwardly and the bottom edge is bent inwardly so as to form a top flap 21 and a bottom flap 22, respectively. The front end of the drawer side top flap 21 is such that it is disposed at the same height as the top of the upper embossed portion 54 of the holding plate 50, when the fitting 100 is assembled. The drawer side bottom flap 22 is engagable with the drawer bottom panel 40 for mounting the bottom panel 40 thereat. The front end of each drawer side 20 is provided with a pair of recesses 23, 24 located one above the other, the top recess 23 through which the assembly screw 80 passes and the bottom recess 24 through which the eccentric 90 passes. Both recesses 23, 24 are open towards the front edge of the drawer side 20. A projection 25, preferably integral with the drawer side 20, having a flat face 26 substantially parallel to the front edge of the drawer side 20 is provided on the major face of the drawer side 20 that confronts the clamping plate 60, behind both recesses 23, 24. However, it is also conceivable that the projection 25 be separately attached onto the drawer side 20 and possibly made from a different material than that of the drawer side 20. The flat face 26 of the drawer side projection 25 abuts against the flat front edge 65 of the clamping plate depression 64 and forms a locking stop between the drawer side 20 and the clamping plate 60, when the fitting is fully assembled and the drawer side 20 is said to be affixed to the drawer front panel 10.

Figure 5A:
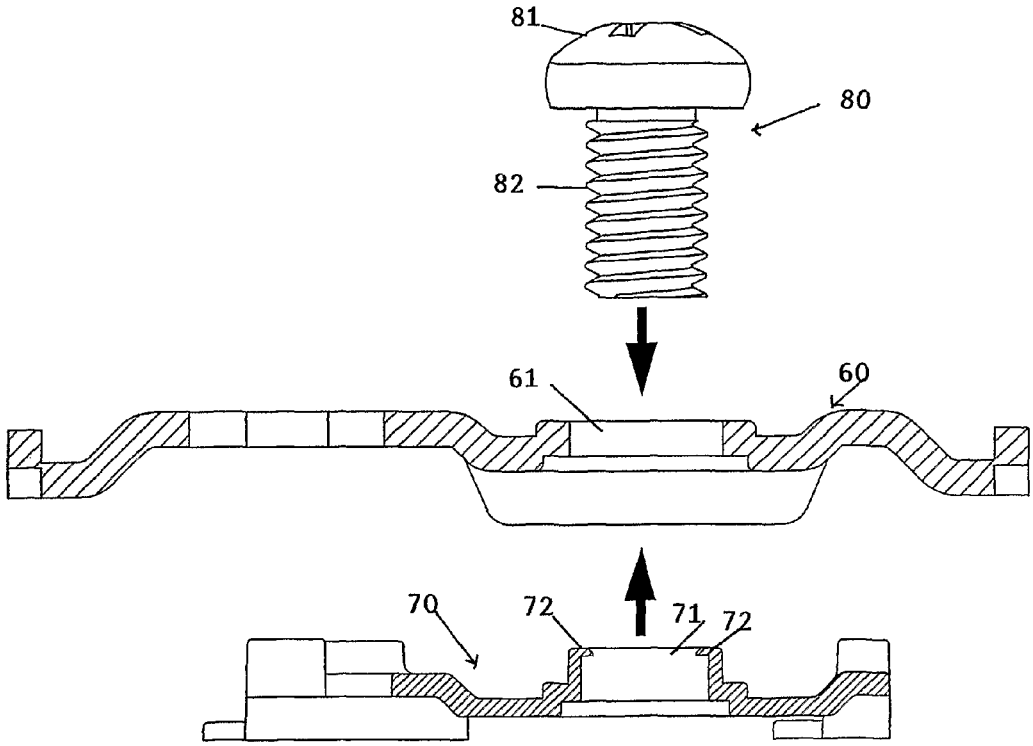
FIG. 5A shows a cross sectional view of the guide clip being mounted onto the clamping plate and coupled with the assembly screw of a drawer fitting of FIG. 2.
Figure 5B:
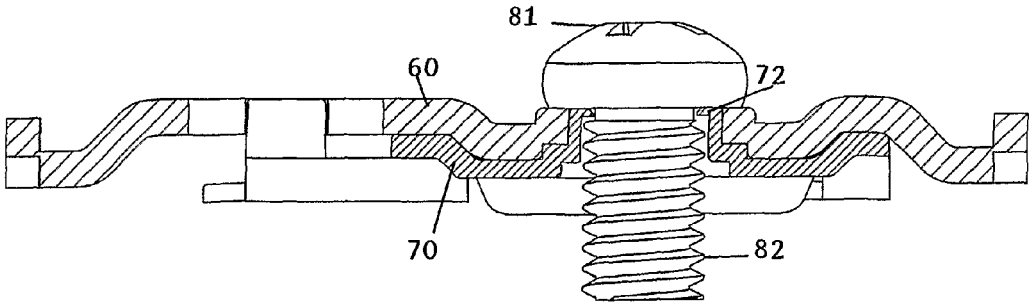
FIG. 5B shows a cross sectional view of the guide clip mounted onto the clamping plate and both the guide clip and clamping plate coupled with the assembly screw of a drawer fitting of FIG. 2.
Figure 6B:
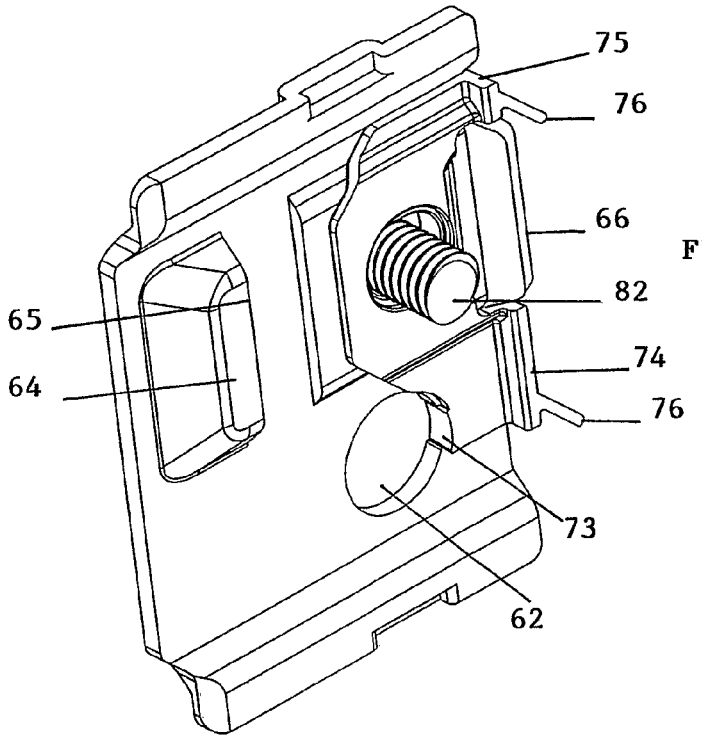
FIG. 6B is a perspective view of FIG. 5B as seen from a surface of the clamping plate that confronts the side panel.

When assembling the drawer fitting 100, firstly, the guide clip 70 is mounted onto the inner face of the clamping plate 60, as shown in FIGS. 5A and 5B. The guide clip 70 is positioned at the inner face of the clamping plate 60 such that the guide clip opening 71 is aligned with the first opening 61 of the clamping plate 60. Subsequently, the guide clip 70 is mounted onto the clamping plate 60 by inserting the clip mounting tab 73 into the cut-in section 63 of the clamping plate second opening 62. In this state, as shown in FIGS. 6A and 6B, both the top 75 and bottom 74 front edge flanges of the guide clip 70 are abutting against the front edge of the clamping plate 60 such that the angled flange 66 of the clamping plate 60 is located therebetween. The assembly screw 80 is then passed through both the guide clip opening 71 and the clamping plate first opening 61. Coupling of the assembly screw 80 with the guide clip 70 holding the clamping plate 60 therebetween occurs as the retaining shoulders 72 of the guide clip opening 71 are caught between the head portion 81 and the thread portion 82 of the assembly screw 80.

Secondly, the coupled together assembly screw 80, guide clip 70 and clamping plate 60, is then engaged onto the holding plate flange 55. This is achieved by inserting the thread portion 82 of the assembly screw 80 into the first aperture 57 of the holding plate flange 55. In this position, the eccentric 90 received within the holding plate flange second aperture passes through the second opening 62 of the clamping plate 60, thus enabling the eccentric 90 to be accessible and turned by a suitable tool such as a screwdriver.

Also, when in this position, the angled flange 66 of the clamping plate 60 is resting on the tip portion of the holding plate flange guide formation 56.

Following that, the holding plate 50 of the drawer fitting 100, having the assembly screw 80, clamping plate 60 and guide clip 70, engaged on its flange 55, is then mounted onto the rear surface of the drawer front panel 10 at a longitudinal end, by a screw through the holding plate openings 51. In this position, the guide clip projecting tails 76 are resting against the surface portion 58 of the holding plate 50 at the rear of the drawer front panel 10, at a first angle $Z^1$.

Figure 7:
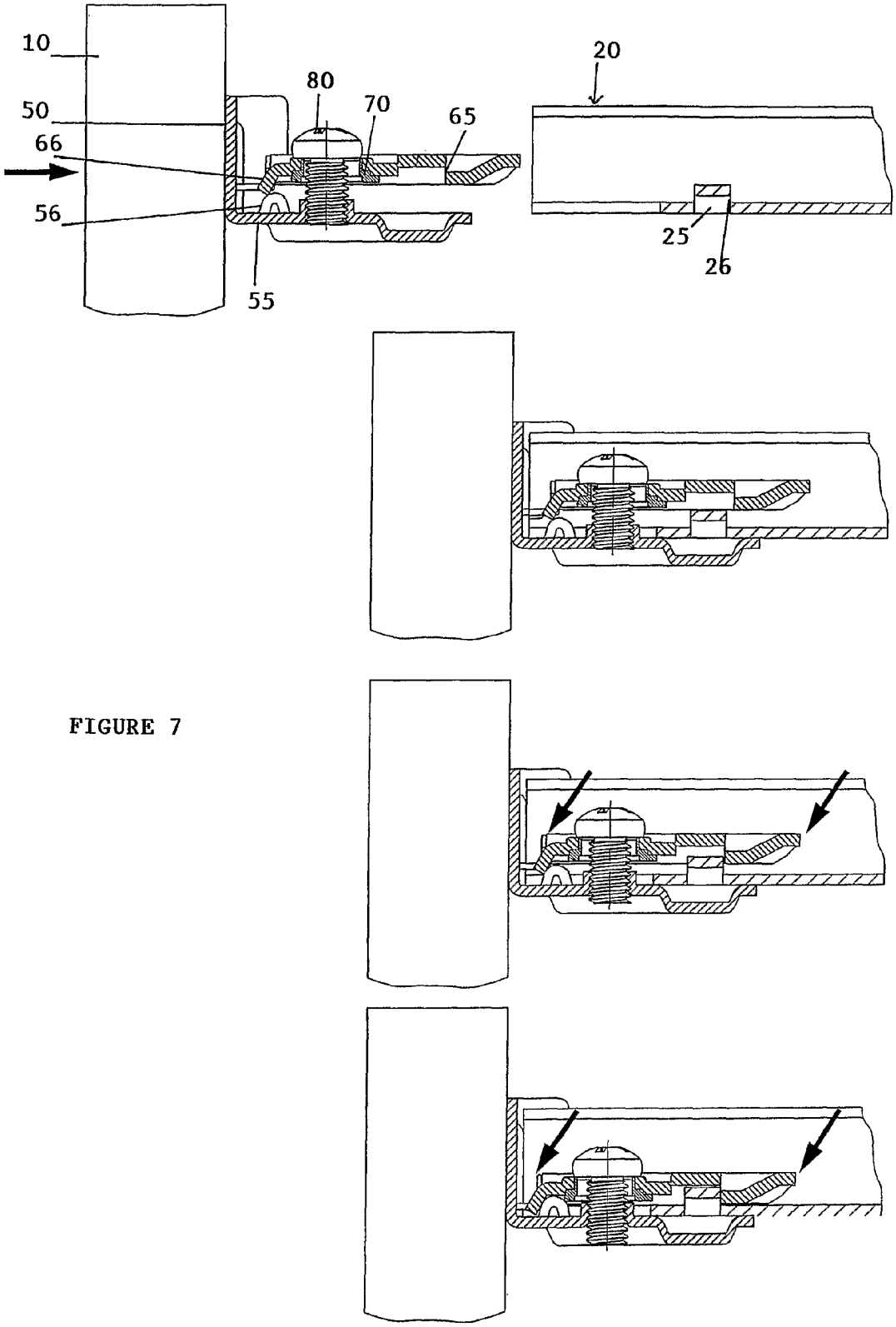
FIG. 7 is a cross sectional view of the drawer fitting of FIG. 2 as a drawer side is affixed to a longitudinal end of the drawer front panel.

Subsequently, as seen in FIG. 7, the drawer front panel 10 having the drawer fitting 100 mounted thereon is fixed together with a respective drawer side 20. The drawer side 20, oriented with its front edge having the two open recesses 23, 24 facing towards the holding plate 50 (rear surface of drawer front panel 10), is guided towards the holding plate 50 until both the assembly screw 80 and eccentric 90 within the first 61 and second 62 openings of the clamping plate 60 are accessible through the top 23 and bottom 24 recesses, respectively of the drawer side 20. When the drawer side 20 is in this position, the flat face 26 of its projection 25 is partially resting against the flat front edge 65 of the clamping plate depression 64 (or projection when viewed from side panel).

Figure 8:
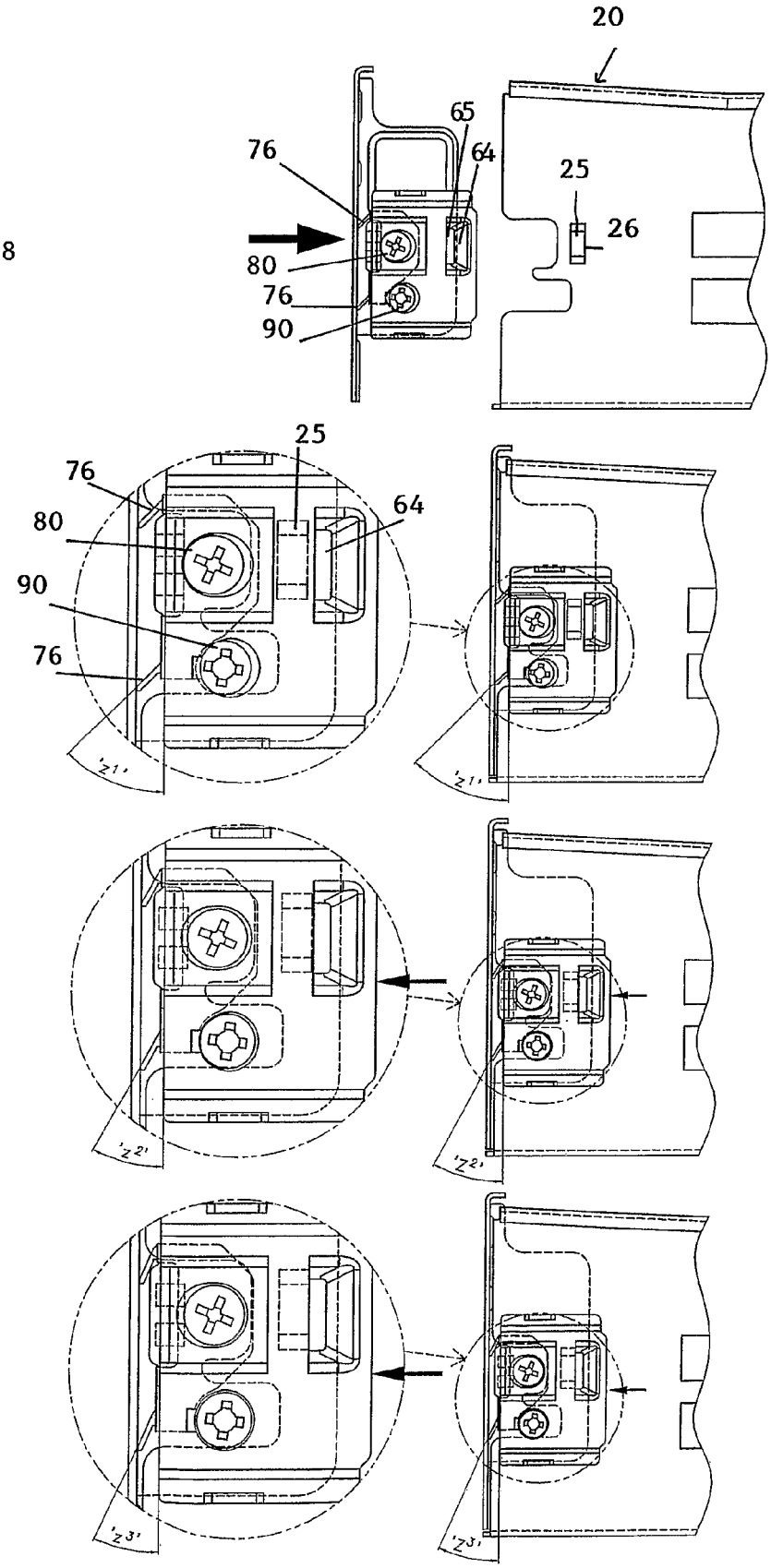
FIG. 8 shows a side view of the drawer fitting of FIG. 2 as a drawer side is affixed to a longitudinal end of the drawer front panel.

Finally, clamping force is applied to the drawer fitting 100 by tightening the assembly screw 80. This will result in the clamping plate angled flange 66, initially resting against the tip of the guide formation 56, riding over the guide surface of the holding plate guide formation 56 such that the clamping plate 60 is simultaneously moved laterally towards the holding plate flange 55 and forwardly towards the front portion of the holding plate 50 that is attached to the rear surface of drawer front panel 10. Such movement of the clamping plate 60 will result in the guide clip projecting tails 76, initially resting against the surface portion 58 of the holding plate 50 at a rear of the front panel 10 at a first angle $Z^1$, being pressed against the surface portion 58 of the holding plate 50 at intermediate and final angles $Z^2$ and $Z^3$, respectively (shown in FIG. 8). Also, as a result of the clamping force, the flat face 26 of the drawer side projection 25 abuts completely against the flat front edge 65 of the clamping plate depression 64 (or projection when viewed from side panel) forming a locking stop thereat. The drawer front panel 10 is thus, securely engaged to the drawer side 20.

In order to disengage the coupling between the drawer front panel 10 and the drawer side 20, the assembly screw 80 is unscrewed so as to release the clamping force. Unscrewing of the assembly screw 80 will result in the assembly screw 80 being moved outwardly or away from the drawer side 20. This resulting movement of the assembly screw 80 will cause the coupled guide clip 70 and clamping plate 60 to be moved away from the holding plate flange 55 together with the assembly screw 80. The synchronized movement of the assembly screw 80 and guide clip 70/clamping plate 60 is possible due to the retaining shoulders 72 of the guide clip opening 71 being caught between the head portion 81 of the assembly screw 80 and the thread portion 82, with the clamping plate 60 held therebetween. Additionally, without the presence of the guide clip 70, loosening of the assembly screw 80 alone will not cause the clamping plate 60 to be moved away from the holding plate flange 55.

As the clamping plate 60 is moved away from the holding plate flange 55, the resilient projecting tails 76 of the guide clip 70, pressed against the surface portion 58 of the holding plate 50, at the rear of the drawer front panel 10 at a final angle $Z^3$, will relax or revert back to their initial state, through an intermediate angle $Z^2$ and finally, first angle $Z^1$, as clamping force is released. This action of the projecting tails 76 will exert a force against the clamping plate 60, thus causing it to be simultaneously withdrawn laterally away from the holding plate flange 55 and rearwardly from the front panel 10. Consequently, the clamping plate 60 and guide clip 70 are maintained substantially parallel to the holding plate flange 55 to facilitate adjustment or removal of the drawer side 20. It is important to ensure that the clamping plate 60 remains parallel with the holding plate flange 55 and not, tilted or caused to rotate sideways, for example, as this will permit the drawer front panel 10 to be easily engaged to the drawer side 20 again, if necessary. Also, if the clamping plate 60 is not parallel with the holding plate flange 55, it may result in the flat face 26 of the drawer side projection 25 not being properly or fully stopped (abutted) against the flat front edge 65 of the clamping plate depression 64 (or projection when viewed from the side panel). For example, the flat front edge 65 of the depression 64 may be caused to rest on top of the projection 25 instead of abutting against the projection flat face 26, when the assembly screw 80 is re-tightened. Such a partial-engagement of the drawer side 20 with the clamping plate 60 (drawer fitting 100) will cause the drawer front panel 10 to be easily disengaged from the drawer side 20.

The assembly screw 80 for use in the drawer fitting 100 of this invention may comprise any suitable type of screw with screws generally known in the art to consist of a head portion 81 and a threaded shaft portion 82. The above-mentioned eccentric 90 is used for adjusting the vertical position of the drawer front panel. Also, all directional statements such as front/forward, back/rear, top, bottom, lateral, inward, outward, made herein are relative to the orientation of the drawer assembly.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefore intended to be embraced therein.

The invention claimed is:

1. A drawer fitting for fixing a drawer side (20) to a drawer front panel (10), said fitting comprising:

a holding plate (50) for mounting the fitting to the drawer front panel, said holding plate having a flange (55) extending in a direction parallel to a drawer side, said flange having a forwardly-disposed guide formation (56);

a clamping plate (60) having a forwardly-disposed angled flange (66) for interaction with the guide formation (56), the plate further comprising a cut-in portion (63);

a guide clip (70) having a tab (73) insertable into the clamping plate cut-in portion (63) for mounting said clip on said clamping plate such that said drawer side front end can be positioned between said holding plate flange and said guide clip, the guide clip further comprising resiliently depressible projecting tails (76); and an assembly screw (80) that passes through the clamping plate and guide clip, and is received in an aperture (57) in said holding plate flange (55) through a recess (23) in a front end of the drawer side (20); wherein, when a clamping force is applied to said fitting by tightening said assembly screw, the clamping plate angled flange (66) rides over the holding plate guide formation (56) so as to simultaneously move the clamping plate with clip both forwardly towards the front panel and laterally towards the holding plate flange (55), movement of said clamping plate toward said drawer front panel causing said guide clip projecting tails (76) to be pressed in at the rear of said drawer front panel; and wherein, when the assembly is loosened by unscrewing the assembly screw (80), the projecting tails (76) relax to push the clamping plate with clip rearwardly while being withdrawn laterally under the screw action, thus maintaining the clamping plate and clip substantially parallel to the holding plate flange to facilitate adjustment or removal of the drawer side.

2. The drawer fitting as claimed in claim 1 wherein the clamping plate (60) further comprises an opening (61) through which the assembly screw (80) passes.

3. The drawer fitting as claimed in claim 2 wherein the clamping plate further comprises a second opening (62) through which an eccentric (90) for adjusting the vertical position of the drawer front panel, passes.

4. The drawer fitting as claimed in claim 3, wherein the holding plate flange (55) further comprises a second aperture corresponding to the clamping plate second opening (62) for receiving the eccentric (90).

5. The drawer fitting as claimed in claim 1 wherein the guide clip (70) further comprises an opening (71) through which the assembly screw (80) passes.

6. The drawer fitting as claimed in claim 5 wherein the guide clip opening (71) further comprises a pair of retaining shoulders (72) disposed to interact with the assembly screw (80) between the screw head portion (81) and screw thread portion (82), so as to couple the assembly screw (80) and guide clip (70) such that the clamping plate (60) is held therebetween.

7. The drawer fitting as claimed in claim 1, wherein the clamping plate (60) further comprises a depression (64).

8. The drawer fitting as claimed in claim 7, wherein the front end of the drawer side further comprises a projection (25) that interacts with said clamping plate depression (64), said interaction forming a locking stop between the drawer side and the clamping plate (60).

9. The drawer fitting as claimed in claim 8, wherein the projection (25) has a flat face (26) substantially parallel to the front edge of the drawer side and the depression (64) has a flat edge (65), the flat face (26) of the projection (25) abutting against the flat edge (65) of the depression (64), forming the locking stop thereat.

10. The drawer fitting as claimed in claim 9, wherein the projection (25) is integral with the drawer side.

11. The drawer fitting as claimed in claim 8, wherein the projection (25) is integral with the drawer side.

12. The drawer fitting as claimed in claim 1 wherein the guide clip projecting tails (76) are integral with the guide clip (70).

13. The drawer fitting as claimed in claim 1 wherein the guide clip is made of a plastic material.

14. The drawer fitting as claimed in claim 1 wherein the drawer side is made of sheet metal.

15. The drawer including a front panel and two drawer sides, each side joined to one longitudinal end of the front panel by a respective drawer fitting as claimed in claim 1.

16. A drawer fitting for fixing a drawer side (20) to a drawer front panel (10), said fitting comprising:

a holding plate (50) for mounting the fitting to the drawer front panel, said holding plate having a flange (55) extending in a direction parallel to a drawer side, said flange having a forwardly-disposed guide formation (56);

a clamping plate (60) having a forwardly-disposed angled flange (66);

a guide clip (70) mountable on said clamping plate such that said drawer side front end can be positioned between said holding plate flange and said guide clip, the guide clip having resiliently depressible projecting tails (76); and an assembly screw (80) that passes through and couples together the clamping plate and guide clip, and is received in an aperture (57) in said holding plate flange (55) through a recess (23) in a front end of the drawer side (20); wherein, when a clamping force is applied to said fitting by tightening said assembly screw, the clamping plate angled flange (66) rides over the holding plate guide formation (56) so as to simultaneously move the clamping plate with clip both forwardly towards the front panel and laterally towards the holding plate flange (55), movement of said clamping plate toward said drawer front panel causing said guide clip projecting tails (76) to be pressed in at the rear of said drawer front panel; and wherein, when the assembly is loosened by unscrewing the assembly screw (80), the projecting tails (76) relax to push the clamping plate with clip rearwardly while being withdrawn laterally under the screw action, thus maintaining the clamping plate and clip substantially parallel to the holding plate flange to facilitate adjustment or removal of the drawer side, the guide clip (70) having a guide clip opening (71), which comprises a pair of retaining shoulders (72) disposed to interact with the assembly screw (80) between the screw head portion (81) and screw thread portion (82), so as to couple the assembly screw (80) and guide clip (70) such that the clamping plate (60) is held therebetween.

* * * * *